US006439994B2

(12) United States Patent
Tsukahara

(10) Patent No.: US 6,439,994 B2
(45) **Date of Patent: *Aug. 27, 2002**

(54) GAMING MACHINE

(75) Inventor: Nakayasu Tsukahara, Tokyo (JP)

(73) Assignee: Aruze Corporation, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/427,484

(22) Filed: Oct. 27, 1999

(30) Foreign Application Priority Data

Oct. 28, 1998 (JP) ..... 10-306687

(51) Int. Cl.[7] ..... A63F 9/24
(52) U.S. Cl. ..... 463/20; 273/143 R
(58) Field of Search ..... 463/1, 12, 13, 463/16–20, 25–27, 29, 30, 31, 35; 273/138.1, 139, 143 R

(56) References Cited

U.S. PATENT DOCUMENTS 4,618,150 A 10/1986 Kimura
5,024,439 A * 6/1991 Okada ..... 273/143 R
5,603,659 A * 2/1997 Okada ..... 463/25
5,722,891 A * 3/1998 Inoue ..... 463/20
5,989,121 A * 11/1999 Sakamoto ..... 463/20
6,073,930 A * 6/2000 Jones et al. ..... 273/292

FOREIGN PATENT DOCUMENTS

| | | |
|---|---|---|
| DE | 195 15 983 A1 | 11/1996 |
| DE | 196 02 259 A1 | 7/1997 |
| EP | 0 414 427 A2 | 2/1991 |
| GB | 2 087 618 A | 5/1982 |

* cited by examiner

*Primary Examiner*—Joe H. Cheng
*Assistant Examiner*—Kim T. Nguyen
(74) *Attorney, Agent, or Firm*—Ronald R. Snider; Snider & Associates

(57) ABSTRACT

A gaming machine which allows, according to a preset probability of occurrence, a player to play a special game (e.g., big bonus game) more advantageous than a normal game comprises a setting switch 46 for setting the probability of occurrence of big bonus games at a plurality of stages, and an indicator for informing the player of thus set value. The indicator comprises reel lamps 44 adapted to emit light in a plurality of light-emitting patterns while illuminating from inside reels in a transmitting manner the symbols seen through display windows. As the light-emitting patterns in the reel lamps 44 are changed (so as to represent L or H) according to the set value set by the setting switch 46, the player is informed of the setting value set by the setting switch 46. Consequently, the player can fully enjoy games, while the profits of players and game parlors are balanced.

29 Claims, 11 Drawing Sheets

○ SELECTING RATIO

| | RATIO | SELECTING RATIO OF FLASH PATTERN 2 |
|---|---|---|
| SETTING 1 | 18 : 14 | 0.7778 |
| SETTING 2 | 17 : 15 | 0.8824 |
| SETTING 3 | 16 : 16 | 1.0000 |
| SETTING 4 | 15 : 17 | 1.1333 |
| SETTING 5 | 14 : 18 | 1.2857 |
| SETTING 6 | 13 : 19 | 1.4615 |

○ SELECTING RATIO

| | RATIO | SELECTING RATIO OF FLASH PATTERN 2 |
|---|---|---|
| SETTING 1 | 18 : 14 | 0.7778 |
| SETTING 2 | 17 : 15 | 0.8824 |
| SETTING 3 | 16 : 16 | 1.0000 |
| SETTING 4 | 15 : 17 | 1.1333 |
| SETTING 5 | 14 : 18 | 1.2857 |
| SETTING 6 | 13 : 19 | 1.4615 |

FLASH PATTERN 1 FIG.5

FLASH PATTERN 2

FIG.6

| STAGE | BLINKING PATTERN | STAGE | BLINKING PATTERN |
|---|---|---|---|
| 1 | Z(1) Z(2) Z(3)<br>Z(4) Z(5) Z(6)<br>Z(7) Z(8) Z(9) | 6 | Z(1) Z(2) Z(3)<br>Z(4) Z(5) Z(6)<br>Z(7) Z(8) Z(9) |
| 2 | Z(1) Z(2) Z(3)<br>Z(4) Z(5) Z(6)<br>Z(7) Z(8) Z(9) | | |
| 3 | Z(1) Z(2) Z(3)<br>Z(4) Z(5) Z(6)<br>Z(7) Z(8) Z(9) | | |
| 4 | Z(1) Z(2) Z(3)<br>Z(4) Z(5) Z(6)<br>Z(7) Z(8) Z(9) | | |
| 5 | Z(1) Z(2) Z(3)<br>Z(4) Z(5) Z(6)<br>Z(7) Z(8) Z(9) | | |

ON

OFF

FIG.11

| BB WINNING SOUND | SOUND OUTPUTTING CONDITION | | | APPORTIONING RATIO | |
|---|---|---|---|---|---|
| | SET VALUE | RANDOM NUMBER 1 (1/8) | RANDOM NUMBER 2 (1/2) | ODD NUMBER SETTING | EVEN NUMBER SETTING |
| BB WINNING SOUND 1 | ODD | WINNING | — | 2/16 | |
| BB WINNING SOUND 2 | ODD | LOSING | LOSING | 7/16 | |
| | EVEN | WINNING | — | | 2/16 |
| | EVEN | LOSING | LOSING | | 7/16 |
| BB WINNING SOUND 3 | ODD | LOSING | WINNING | 7/16 | |
| | EVEN | LOSING | WINNING | | 7/16 |

GAMING MACHINE

RELATED APPLICATIONS

This application claims the priority of Japanese Patent Application No. 10-306687 filed on Oct. 28, 1998, which is incorporated herein by reference.

BACKGROUND OF THE INVENTION

1. Field of the Invention

The present invention relates to a gaming machine, such as slot machine, pachinko machine, pachislo gaming machine, or the like; and, in particular, to a gaming machine adapted to inform a player of an estimation of the probability of occurrence of a special game.

2. Description of the Prior Art

A conventional gaming machine will be explained, by way of example, in regard to a slot machine which is a typical gaming machine.

A conventional slot machine can start a game when a game medal is inserted therein. When a player operates a start switch after a game starting condition is set in order, a plurality of reels rotate, so that a plurality of symbols formed on the surface of each reel move at a high speed. Then, when the player operates the respective stop switches corresponding to the individual reels, the latter stop rotating, whereby a plurality of symbols formed on the reel surfaces are displayed in their stopped state.

Here, in the case where the symbols thus displayed in their stopped state constitute a predetermined combination, then game medals are paid out or a special game known as so-called big bonus game can be played.

Though each reel stops according to the operation of its corresponding stop switch performed by the player, the stopping position of the respective reel is not determined solely depending on the operation timing of the stop switch. Namely, the slot machine is controlled by a control unit such that winning modes occur at a predetermined probability of occurrence, while the reels are controlled to rotate and stop such that, only when a winning mode is allowed to occur by the control unit, the mode of symbols displayed in their stopped state constitute this winning mode.

This feature is aimed at balancing the profit of players against the profit of game parlors, and eliminating differences in gaming skills among the players and thereby allowing the games to be played fairly. For example, the probability of occurrence of a big bonus game, which is a special game, can be set at six stages within the range of 1/240 to 1/300. The control unit controls the reels to rotate and stop according to thus set probability of occurrence, thereby generating big bonus games.

Meanwhile, players wish to know the probability of occurrence of special games in each gaming machine in order to play games more advantageously. Namely, if the players can perceive the probability of occurrence of special games in each gaming machine, they can enhance the expectation of occurrence of special games, thereby being able to further enjoy gaming.

In view of the above-mentioned circumstances, it is an object of the present invention to provide a gaming machine which allows, according to a preset probability of occurrence, a player to play a special game more advantageous than a normal game, the gaming machine being further adapted to allow the player to fully enjoy the pleasure of gaming by informing the player of the probability of occurrence of the special game.

If the probability of occurrence of the special game is reported to the player in detail, however, there will be a possibility of games being played only with the gaming machines advantageous to players, whereby the balance between the profit of players and the profit of the game parlors may be lost. If the balance between the profit of players and the profit of game parlors cannot be established, games cannot be played soundly. On the other hand, if the players can estimate, to a certain degree, which probability of occurrence of special games the gaming machines playing games are set at, they can select the gaming machines assumed to be set at a higher probability of occurrence, so as to play games therewith, whereby the pleasure of gaming in the gaming machines may further enhance.

Therefore, when informing players of the probability of occurrence of special games in each gaming machine, it may be considered preferable that, instead of the detailed probability of occurrence of special games, somewhat rough one be indicated.

Also, as with the above-mentioned slot machine, other gaming machines such as pachinko machine, pachislo gaming machine, and the like include those which preset the probability of occurrence of special games and allow players to play the special games according to thus set probability of occurrence, thereby having similar problems.

Therefore, it is another object of the present invention to provide a gaming machine which allows, according to a preset probability of occurrence, a player to play a special game more advantageous than a normal game, the gaming machine being further adapted to allow the player to fully enjoy the pleasure of gaming, while balancing the profits of players and game parlors, by informing the player of an estimation of the probability of occurrence of the special game.

SUMMARY OF THE INVENTION

For achieving the above-mentioned object, the gaming machine of the present invention has the following characteristic features.

The gaming machine in accordance with a first aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising apparatus for setting the probability of occurrence of the special game at a plurality of stages, and an indicator for informing the player of a set value set by the apparatus for setting.

The gaming machine in accordance with a second aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising apparatus for setting the probability of occurrence of the special game at a plurality of stages, and an indicator for informing the player of a set value set by the apparatus for setting, wherein the indicator comprises light-emitting source adapted to emit light in a plurality of light-emitting patterns, the light-emitting patterns in the light-emitting source being changed according to the set value set by the apparatus for setting, so as to inform the player of the set value set by the apparatus for setting.

The gaming machine in accordance with a third aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising apparatus for setting the probability of occurrence of the special game at a plurality of stages, and an indicator for informing the player of a set value set by the apparatus for setting, wherein the indicator comprises sound effect generator adapted to generate a plurality of sound effect patterns, the sound effect patterns generated from the sound effect generator being changed according to the set value set by the apparatus for setting, so as to inform the player of the set value set by the apparatus for setting.

The gaming machine in accordance with a fourth aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising apparatus for setting the probability of occurrence of the special game at a plurality of stages, and an indicator for informing the player of a set value set by the apparatus for setting; wherein the indicator comprises light-emitting source adapted to emit light in a plurality of light-emitting patterns, and sound effect generator adapted to generate a plurality of sound effect patterns, the light-emitting patterns in the light-emitting source and the sound effect patterns generated from the sound effect generator being changed according to the set value set by the apparatus for setting, so as to inform the player of the set value set by the apparatus for setting.

The gaming machine in accordance with a fifth aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising apparatus for setting the probability of occurrence of the special game at a plurality of stages; random number generator for generating a random number within a predetermined numerical range; apparatus for determining, according to a set value set by the apparatus for setting and a random number value generated by the random number generator, an estimation of the set value set by the apparatus for setting; and an indicator for informing, according to the determination made by the apparatus for determining, the player of the estimation of the set value set by the apparatus for setting.

The gaming machine in accordance with a sixth aspect of the present invention has the characteristic features of that in accordance with the fifth aspect, and is further characterized in that the apparatus for determining determines the estimation of the set value by adding the set value set by the apparatus for setting and the random number value generated by the random number generator together and ranking the resulting value under a predetermined condition, and in that the indicator performs an indication corresponding to the ranking effected by the apparatus for determining.

The gaming machine in accordance with a seventh aspect of the present invention has the characteristic features of that in accordance with the fifth or sixth aspect, and is further characterized in that the indicator comprises light-emitting source adapted to emit light in a plurality of light-emitting patterns, the light-emitting patterns in the light-emitting source being changed, so as to inform the player of the estimation of the set value set by the apparatus for setting.

The gaming machine in accordance with an eighth aspect of the present invention has the characteristic features of that in accordance with the fifth or sixth aspect, and is further characterized in that the indicator comprises sound effect generator adapted to generate a plurality of sound effect patterns, the sound effect patterns generated from the sound effect generator being changed, so as to inform the player of the estimation of the set value set by the apparatus for setting.

The gaming machine in accordance with a ninth aspect of the present invention has the characteristic features of that in accordance with the fifth or sixth aspect, and is further characterized in that the indicator comprises light-emitting source adapted to emit light in a plurality of light-emitting patterns, and sound effect generator adapted to generate a plurality of sound effect patterns, the light-emitting patterns in the light-emitting source and the sound effect patterns generated from the sound effect generator being changed, so as to inform the player of the estimation of the set value set by the apparatus for setting.

The gaming machine in accordance with a tenth aspect of the present invention has characteristic features of that in accordance with one of the first to ninth aspects, and is further characterized in that the indicator performs an indication upon winning of the special game.

Further, the gaming machine in accordance with a first aspect of the present invention is a gaming machine which causes a game to be played on condition that a game medium is inserted therein, and allows a player to play a special game more advantageous than a normal game when a predetermined condition is achieved according to a preset probability of occurrence; the gaming machine comprising setting means for setting the probability of occurrence of the special game at a plurality of stages, and indicating means for informing the player of a set value set by the setting means.

BRIEF DESCRIPTION OF THE DRAWINGS

FIG. 6 is an explanatory view of light-emitting patterns of the reel lamps;

FIG. 11 is an explanatory view of sound outputting conditions for the sound effects of the big bonus game;

DESCRIPTION OF THE PREFERRED EMBODIMENTS

In the following, embodiments of the present invention will specifically be explained with reference to the accompanying drawings.

The following embodiments will be explained, by way of an example, in regard to a slot machine as a typical gaming machine. Also, this slot machine is assumed to use game medals as its game medium.

Slot Machine

Figure 1:
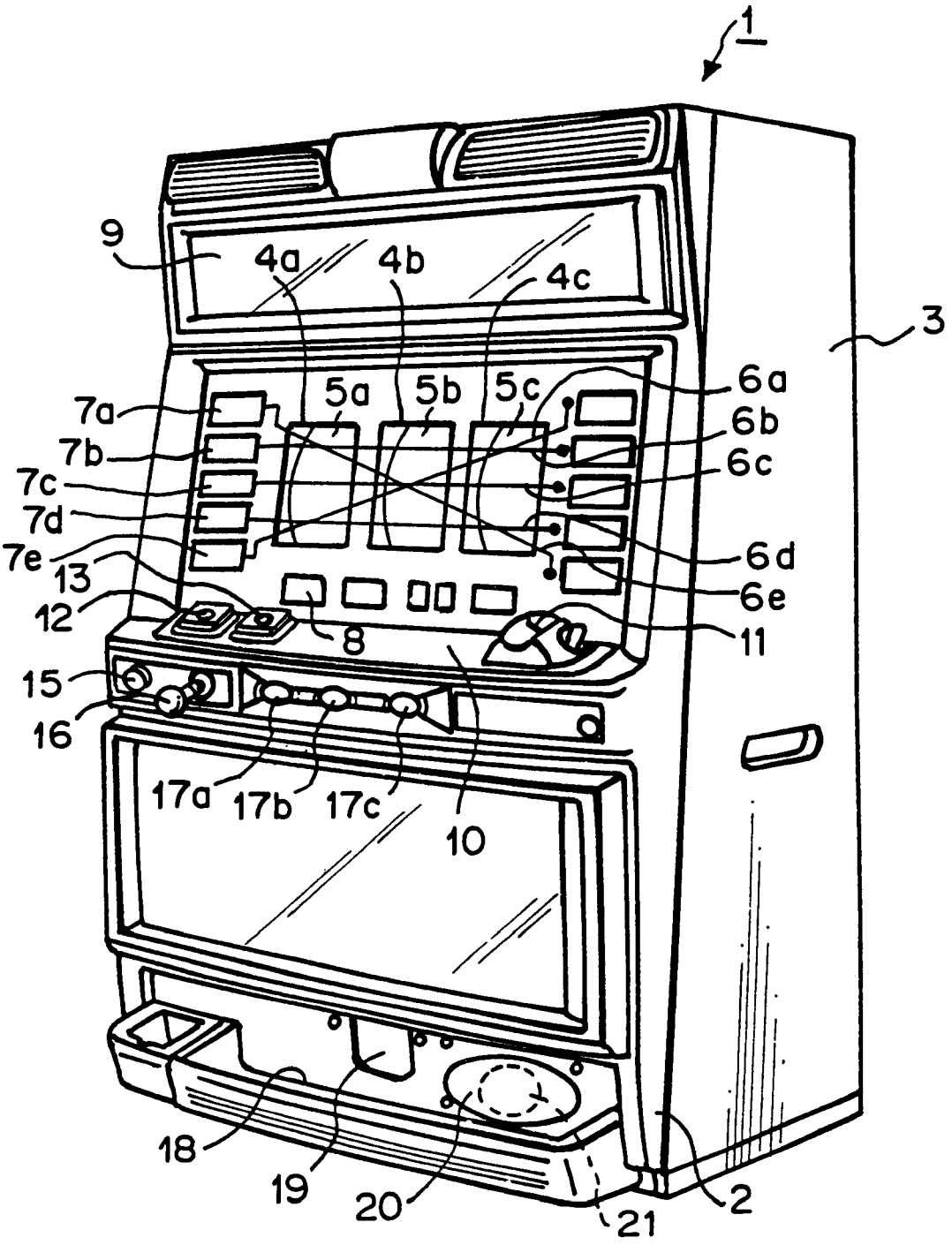
FIG. 1 is a perspective view of a slot machine which is a typical example of the gaming machine in accordance with the present invention.
Figure 2:
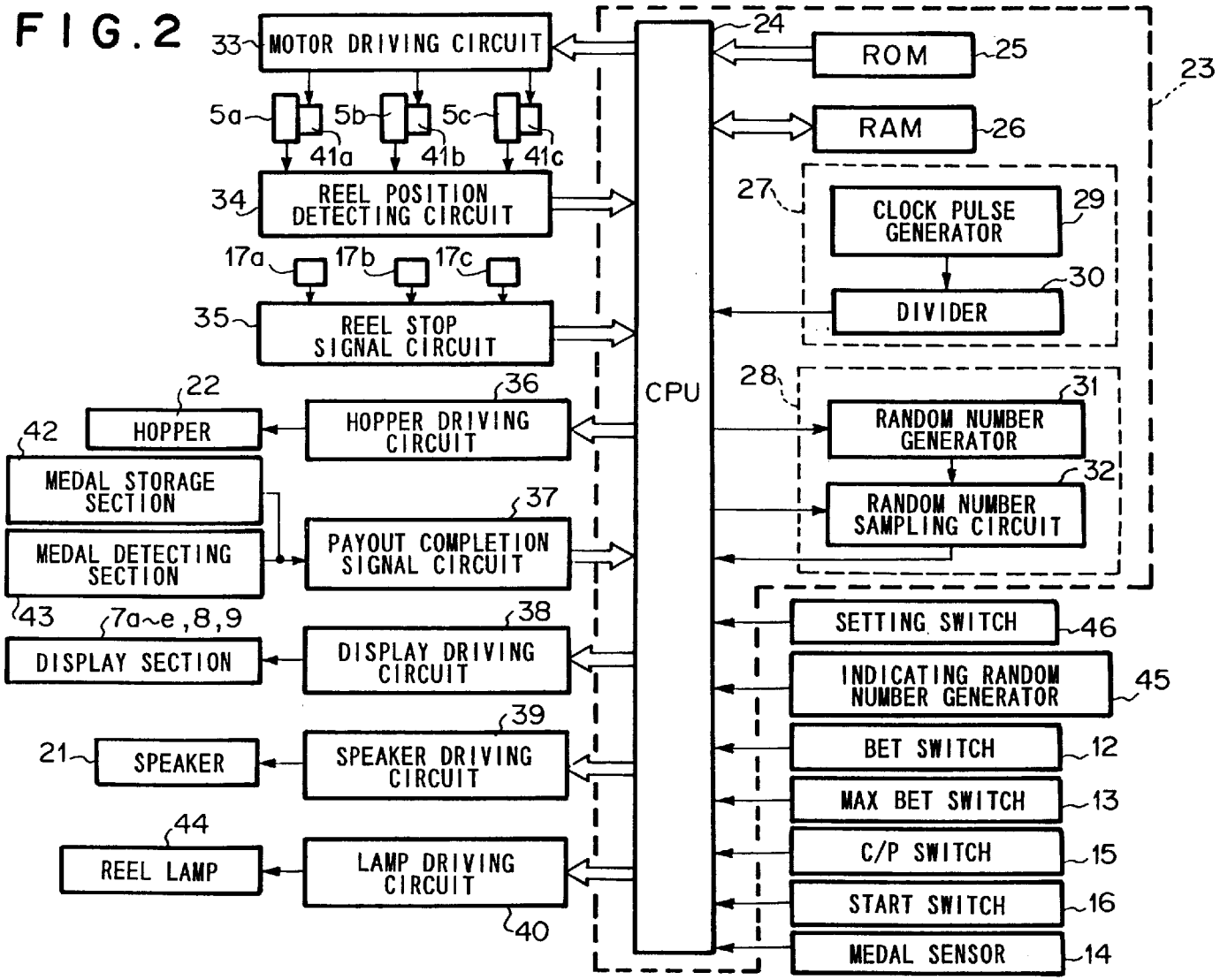
FIG. 2 is a block diagram showing a schematic configuration of the control unit of the slot machine and peripheral devices connected thereto.

FIGS. 1 and 2 show an embodiment of the slot machine in accordance with the present invention. FIG. 1 is a perspective view of this slot machine, whereas FIG. 2 is a block diagram showing the schematic configuration of its control unit and peripheral devices connected thereto.

As shown in FIG. 1, the slot machine 1 in accordance with the present invention has a housing 3 whose front side is provided with a front door 2 which is adapted to open and close. The front door 2 is formed with three display windows 4*a* to 4*c*, aligning left to right, located above near the center of the front face thereof. The respective outer peripheral surfaces of three reels 5*a* to 5*c* disposed within the housing 3 face their corresponding display windows 4*a* to 4*c*. Also, winning line indicators 6*a* to 6*e* for indicating respective effective winning lines are formed across all the display windows 4*a* to 4*c* so as to extend to the peripheries thereof. In the embodiment shown in FIG. 1, five winning line indicators 6*a* to 6*e* in total constituted by three horizontal ones and two oblique ones crossing the horizontal ones are provided. Further, on the left end side of the respective winning line indicators 6*a* to 6*e*, effective line indicator lamps 7*a* to 7*e* for indicating the respective effective winning lines are provided.

Formed in the front door 2 below the display windows 4*a* to 4*c*, as shown in FIG. 1, is a display section such as a credit number display section 8 constituted by a seven-segment LED or the like for displaying the number of credited game medals. Also, a dividend display section 9 for displaying the number of game medals to be paid out in reward for a winning is provided in the upper part on the front side of the housing 3.

The front face of the front door 2 below the credit number display section 8 is provided with a shelf 10 which is downwardly inclined toward the front side of the front door 2. This shelf 10 is provided with a medal insertion slot 11 for inserting game medals used for gaming, a bet switch 12 for inserting, one by one, game medals used for gaming within a credited range, and a max bet switch 13 for inserting the game medals used for gaming up to the maximum permissible bet number. Also, a medal sensor 14 (shown in FIG. 2) for detecting game medals is disposed in a medal path (not depicted) communicating with the medal insertion slot 11.

Provided in the front face of the front door 2 below the shelf 10 are a C/P switch 15 for changeover between the credit and the payout of the medals acquired by the player, a start switch 16 for starting rotating each of the reels 5*a* to 5*c* on condition that a game medal is inserted, and three stop switches 17*a* to 17*c* for stopping rotating the respective reels 5*a* to 5*c*.

Further provided in the lower part of the front door 2 is a medal tray 18 for receiving the game medals paid out as a prize, and a medal payout slot 19 facing the medal tray 18. A sound transmission hole 20 is formed on the right side of the medal payout slot 19, whereas a speaker 21 is provided within the housing 3 so as to face the sound transmission hole 20.

Within the housing 3, the reels 5*a* to 5*c* are rotatably disposed at their respective positions where their outer peripheral surfaces face their corresponding display windows 4*a* to 4*c*, whereas a hopper 22 (shown in FIG. 2) for paying out game medals as a prize is disposed at a position communicating with the medal payout slot 19. Also, a control unit 23 (shown in FIG. 2) for electrically controlling the slot machine 1 is disposed within the housing 3.

A light-transparent reel tape having a plurality of kinds of symbols displayed thereon at predetermined intervals is attached to the outer peripheral surface of each of the reels 5*a* to 5*c*. The kinds of symbols include "7," "BAR," "watermelon," "bell," "plum," "cherry," and the like, for example, and each of the reels 5*a* to 5*c* displays 21 symbols. Here, the kinds of symbols and the number of symbols displayed in each of the reels 5*a* to 5*c* can be changed as appropriate.

Disposed inside each of the reels 5*a* to 5*c* are three reel lamps 44 (shown in FIG. 2) in a vertical row for illuminating from inside the respective reel 5*a* to 5*c* in a transmitting manner the symbols seen through their corresponding display windows 4*a* to 4*c*. As the reel lamps 44 are lit, each of the reels 5*a* to 5*c* can be illuminated from inside, whereby the symbols displayed in their stopped state on effective winning lines can be highlighted.

Also disposed within the housing 3 is a setting switch 46 (shown in FIG. 2) for setting the probability of occurrence of so-called big bonus games.

Though not depicted in detail, this setting switch 46 is constituted by a key type setting switch in synchronization with a power switch, and a reset switch or the like, for example.

For setting the probability of occurrence of big bonus games by the setting switch 46, the power switch is once turned OFF, and then, while the key type setting switch is turned ON, the power switch is turned ON.

This operation clears all the values stored in the RAM area except for the set value of probability of occurrence of big bonus games, the state of the changeover switch for selecting whether to carry out the play-out processing or not, and the state of the changeover switch for selecting whether to carry out automatic accounting or not. Also, the set value of probability of occurrence of big bonus games at present is displayed in the display section provided in the front face of the slot machine 1. The set value at present is displayed by a game medal payout number display section, constituted by a seven-segment LED or the like, for example, for indicating the number of game medals to be paid out as a prize.

In this state, every time the reset switch is operated, the set value of probability of occurrence of big bonus games sequentially increases one by one from "1" to "6" and is displayed in a circulating fashion.

After the set value of probability of occurrence of big bonus games is thus selected, the set value is fixed when the reel rotation starting device is actuated upward or downward.

Subsequently, when the key type setting switch is turned OFF, the set value of probability of occurrence of big bonus games, the state of the changeover switch for selecting whether to carry out the play-out processing or not, and the state of the changeover switch for selecting whether to carry out automatic accounting or not are temporarily held, the RAM area is cleared, and then the temporarily held set value and the like are stored into the RAM area again.

During the setting of the probability of occurrence of big bonus games, the C/P switch 15 is switched to the state ready for returning the game medals. After the set value is fixed, the display of the game medal payout display section is turned OFF, the game medal insertion lamp is blinked, and "0" is displayed in the credit number display section 8, whereby a game in the slot machine 1 can be started.

The set value of the probability of occurrence of big bonus games at present can be confirmed by turning ON the key type setting switch. The set value at present is displayed in the game medal payout display section in this case as well. However, the set value cannot be confirmed during the playing of big bonus games or regular bonus games, during the replaying, in the play-out state, during the occurrence of errors, during the payout of game medals, and during the collecting of game medals.

Here, as mentioned above, the set value of probability of occurrence of big bonus games can be set at the six stages of "1" to "6," whereas the individual set values correspond to six stages of the probability of occurrence within the range of 1/240 to 1/300, respectively. As the control unit 23 controls the reels 5*a* to 5*c* so as to make them rotate and stop according to thus set values, big bonus games are generated.

Game in Slot Machine

To begin with, for playing a game with the slot machine 1, game medals are actually inserted into the medal insertion slot 11, or the bet switch 12 or the max bet switch 13 is operated such that game medals used for gaming are inserted within the credit range. Here, effective winning lines are determined according to the number of inserted game medals, and their corresponding effective line indicator lamps 7*a* to 7*e* are lit. For example, one horizontal line in the middle becomes effective when one game medal is inserted; three horizontal lines in the upper, middle, and lower parts become effective when two game medals are inserted; and five lines in total consisting of three horizontal lines in the upper, middle, and lower parts and two oblique lines become effective when three game medals, which constitute the maximum permissible bet number, are inserted.

Subsequently, when the player operates the start switch 16, all the reels 5*a* to 5*c* start rotating at once, whereby a plurality of kinds of symbols formed on the respective outer peripheral surfaces of the reels 5*a* to 5*c* are displayed while vertically moving within their corresponding display windows 4*a* to 4*c*. When the rotation of each reel 5*a* to 5*c* reaches a predetermined speed, its corresponding stop switch 17*a* to 17*c* is made effective. Then, as the player operates each stop switch 17*a* to 17*c*, its corresponding reel 5*a* to 5*c* stops rotating.

Here, in the case where the combination of the symbols displayed on an effective winning line in their stopped state constitutes a predetermined winning mode, the number of game medals corresponding to this winning mode are paid out as a prize or added as a credit.

Predetermined winning modes include those of normal games and those of special games more advantageous than the normal games to the player. Further, the winning modes of special games include those of so-called big bonus games and those of so-called regular bonus games.

The winning modes of normal games include, for example, the cases where the combination of the symbols displayed on an effective winning line in their stopped state is constituted by "bell," "bell," and "bell": where the combination is constituted by "orange," "orange," and "orange"; where "cherry" is displayed in its stopped state in the left display window; and the like, whereby a predetermined number of, e.g., two to eight, game medals are paid out.

In addition, winning modes for replay may be set, so as to allow the player to play a game again under the same condition as that of the last game.

Big Bonus Game

The winning modes of big bonus games are concerned with games started on condition that the combination of symbols displayed on an effective winning line in their stopped state is constituted by "7," "7," and "7," for example, whereby a predetermined number of, e.g., 15, game medals are paid out, while big bonus games which are more advantageous than normal games to the player are allowed to be played.

In a big bonus game, the so-called regular bonus game can be played three times, and a greater number of game medals can be acquired as compared with a normal game.

Regular Bonus Game

The winning modes of regular bonus games are concerned with games started on condition that the combination of symbols displayed on an effective winning line in their stopped state is constituted by "BAR," "BAR," and "BAR," for example, whereby a predetermined number of, e.g., 15, game medals are paid out, while regular bonus games are allowed to be played.

In a regular bonus game, a predetermined number of game medals are inserted, and the start switch 16 is operated, so as to start rotating the reels 5*a* to 5*c*. Thereafter, the stop switches 17*a* to 17*c* are operated, so as to stop rotating their corresponding reels 5*a* to 5*c*.

Then, if the symbols displayed on an effective line in their stopped state constitute a predetermined combination, a predetermined number of, e.g., 15, game medals will be paid out.

In this regular bonus game, the maximum number of games and the maximum number of winning are limited. For example, when the above-mentioned game is played 12 times, i.e., the maximum number of games is reached, or the above-mentioned winning is attained 8 times, i.e., the maximum number of winning is reached, then the regular bonus game is terminated.

The above-mentioned series of gaming actions is controlled by the control unit 23 disposed within the housing 3.

Control Unit

The control unit 23 will be explained with reference to FIG. 2.

As shown in FIG. 2, the control unit 23 comprises a CPU 24, a ROM 25, a RAM 26, a clock circuit 27 for generating an operating clock signal for the CPU 24, a probability setting section 28 for setting the probability of occurrence of big bonus games, and an indicating random number generator 45 for generating a random number used for indicating an estimation of the set value.

The ROM 25 stores therein not only the procedure of processing in games of the slot machine 1 as a sequence program but also data such as a winning probability table and the like for determining the probability of sampling and the like. As the CPU 24 and the like operate according to the sequence program, games in the slot machine 1 are controlled. Hence, the control unit 23 comprising the CPU 24 and the like constitutes a determination means for determining, according to the set value set by the setting switch 46 and the random number value generated by the indicating random number generator 45, the estimation of the set value set by the setting switch 46.

The clock circuit 27 comprises a clock pulse generator 29 for generating a reference clock at a predetermined frequency, and a divider 30 for generating an operating clock signal for the CPU 24 by dividing the reference clock signal.

The probability setting section 28 comprises a random number generator 31 for generating random numbers within a predetermined range under the control of the CPU 24, and a random number sampling circuit 32 for extracting a given random number from the random numbers generated in the random number generator 31 and transmitting thus extracted random number to the CPU 24. Also, the setting switch 46 for setting the probability of occurrence of big bonus games is connected to the probability setting section 28.

The indicating random number generator 45 comprises, for example, an 8-bit refresh register and is adapted to generate 128 random numbers ranging from "0" to "127" when all the bits of the refresh register are used.

Connected to a plurality of I/O ports provided with the CPU 24 are the bet switch 12, the max bet switch 13, the C/P switch 15, the start switch 16, the medal sensor 14, a motor driving circuit 33, a reel position detecting circuit 34, a reel stop signal circuit 35, a hopper driving circuit 36, a payout completion signal circuit 37, a display driving circuit 38, a speaker driving circuit 39, and a lamp driving circuit 40.

In the following, the individual circuits mentioned above will be explained in detail.

Connected to the motor driving circuit 33 are stepping motors 41*a* to 41*c* for driving the respective reels 5*a* to 5*c* to rotate. As driving pulses are supplied or stopped being supplied to the individual stepping motors 41*a* to 41*c* under the control of the CPU 24, the respective reels 5*a* to 5*c* are caused to start or stop rotating.

The reel position detecting circuit 34 is provided with a position detecting sensor comprising an optical sensor or the like for detecting the rotating position of each of the reels 5*a* to 5*c*, so that the position detection signals concerning the reels 5*a* to 5*c* detected by the position detecting sensor are transmitted to the CPU 24.

Connected to the reel stop signal circuit 35 are stop switches 17*a* to 17*c*. As the player operates the stop switches 17*a* to 17*c*, the operation is detected, and the resulting stop switch detection signal is transmitted to the CPU 24.

Connected to the hopper driving circuit 36 is the hopper 22 for storing game medals.

Connected to the payout completion signal circuit 37 are a medal storage section 42 and a medal detecting section 43. The medal storage section 42 is a section for storing the game medals inserted from the medal insertion slot 11 or the game medals to be paid out as a prize, and is adapted to store the game medals until they reach a predetermined maximum permissible storage number. The maximum permissible storage number is 50, for example, so that up to 50 game medals are stored, whereas the 51st and later game medals are actually paid out from the hopper 22 to the medal tray 18. The actually paid-out medals are counted by the medal detecting section 43 at the time when being paid out from the hopper 22 to the medal tray 18. In the operation of paying out game medals at the time of winning, if the sum value stored in the medal storage section 42 in an adding fashion or the counted value in the medal detecting section 43 reaches a predetermined payout number, then a payout completion signal is transmitted from the payout completion signal circuit 37 to the CPU 24.

Connected to the display driving circuit 38 are the effective line indicator lamps 7*a* to 7*e*, the credit number display section 8, and the dividend display section 9. Under the control of the CPU 24, the effective line indicator lamps 7*a* to 7*e* are lit, and displaying is effected in each of the display sections 8, 9. Also, the number of game medals stored in the medal storage section 42 is displayed in the credit number display section 8.

Connected to the speaker driving circuit 39 is the speaker 21 for generating sound effects and the like. Connected to the lamp driving circuit 40 are the reel lamps 44 for illuminating from inside the reels 5*a* to 5*c* in a transmitting manner the symbols seen through the display windows 4*a* to 4*c*.

First Embodiment of Control Processing

In the following, the control processing of the slot machine 1 carried out by the control unit 23 will be explained with emphasis on the process of indicating the probability of occurrence of special games in particular.

To begin with, a first embodiment in which light-emitting patterns of the reel lamps 44 are changed so as to indicate the probability of occurrence of special games will be explained.

Figure 3:
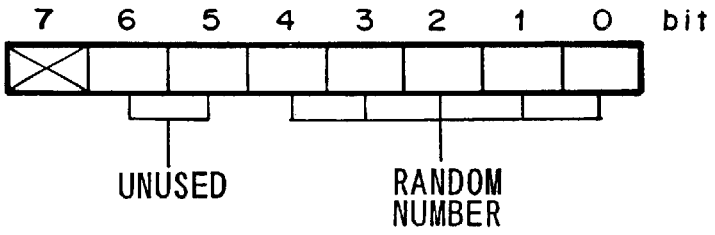
FIG. 3 is a conceptual view of a refresh register in accordance with a first embodiment.
Figure 4:
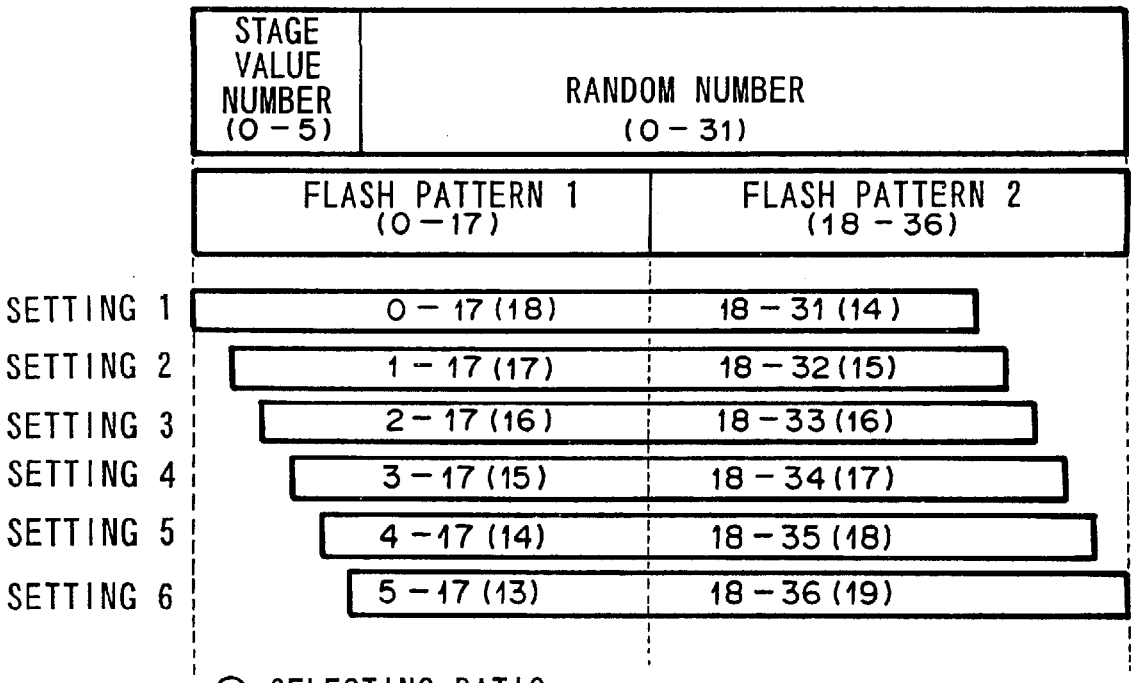
FIG. 4 is an explanatory view showing how light-emitting patterns of reel lamps are selected.
Figure 5:
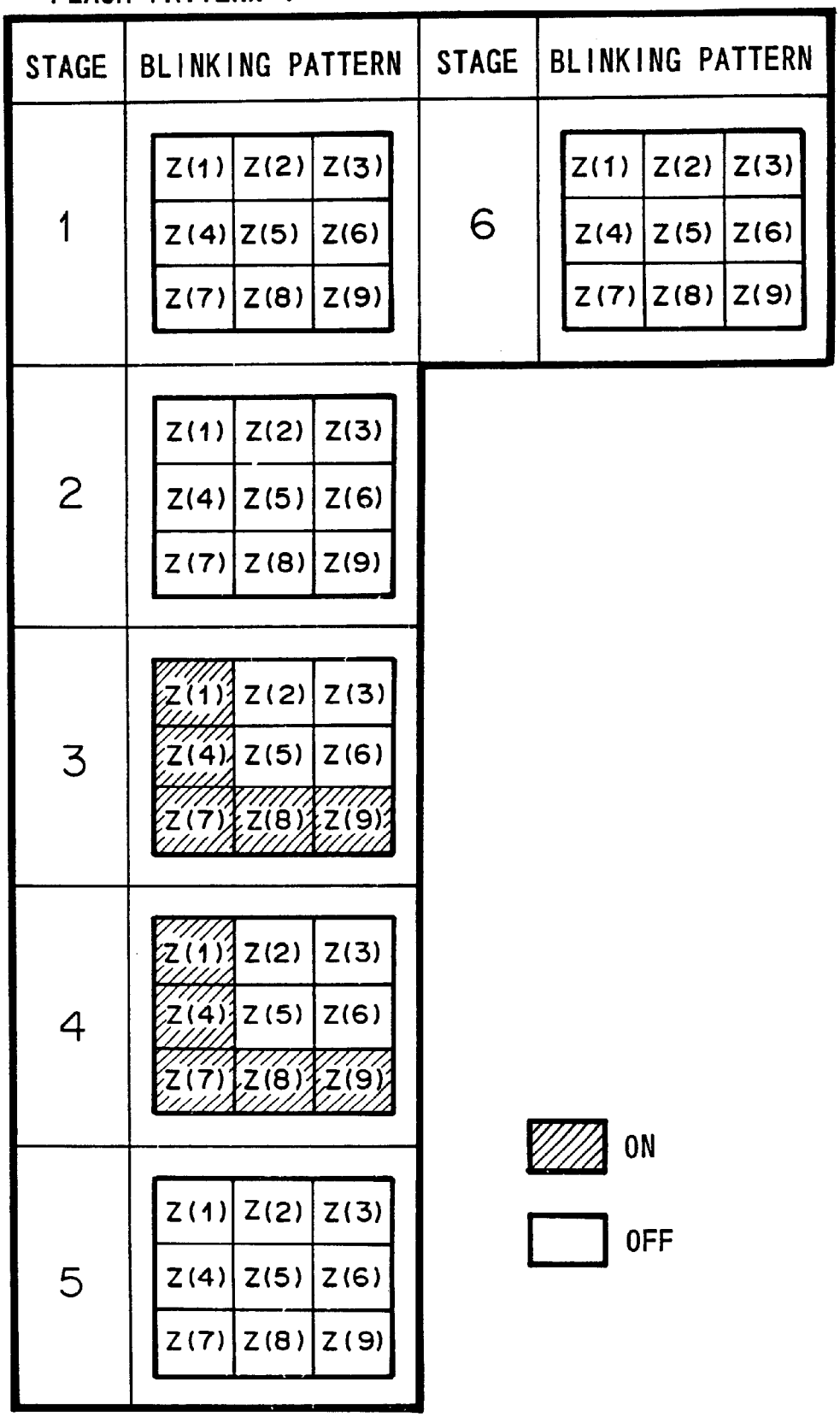
FIG. 5 is an explanatory view of light-emitting patterns of the reel lamps.
Figure 7:
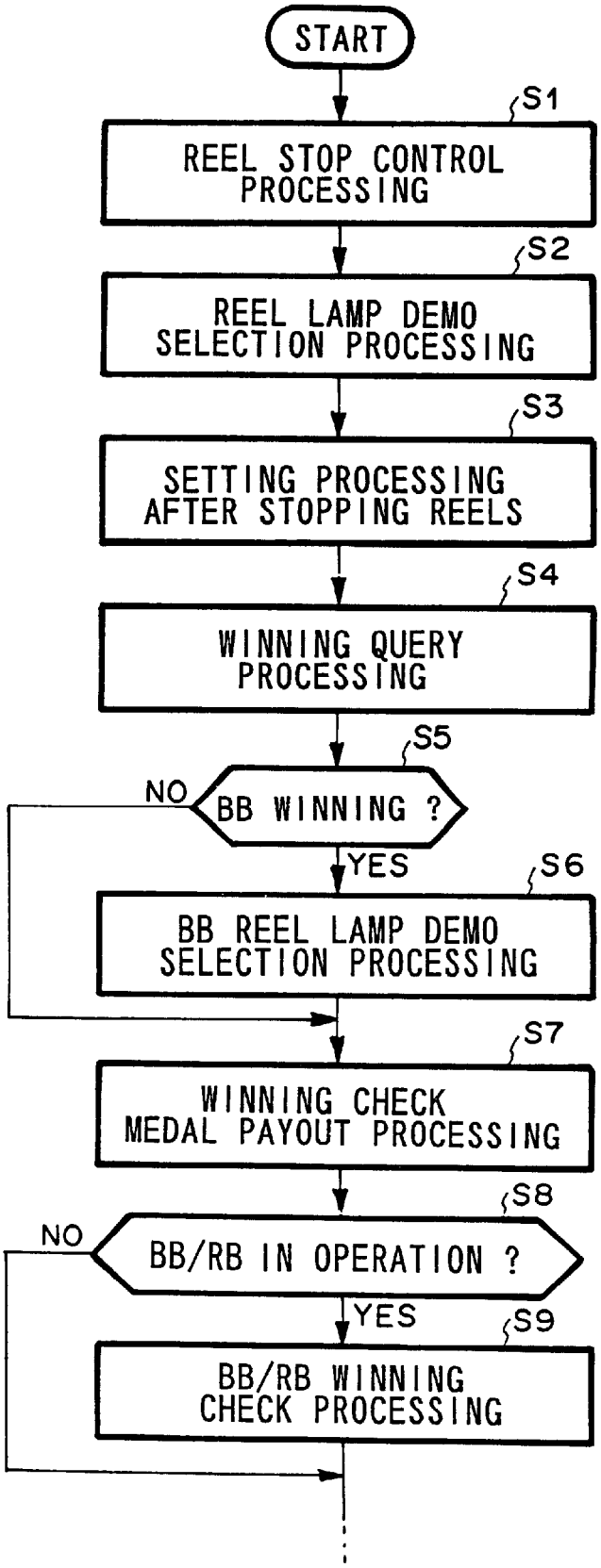
FIG. 7 is a flowchart showing an outlined procedure of control processing in the slot machine in accordance with the first embodiment.
Figure 8:
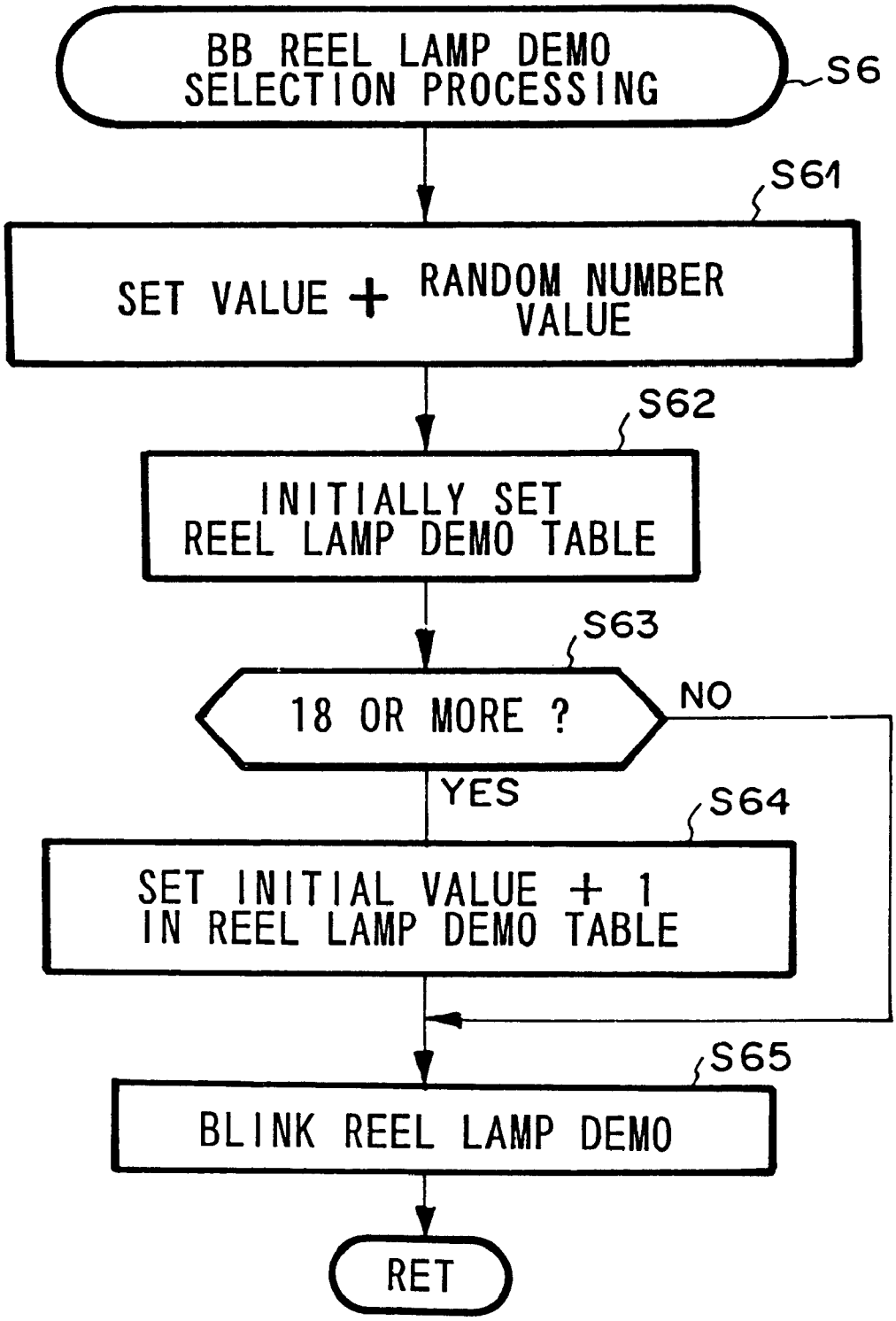
FIG. 8 is a flowchart showing the details of reel lamp demo selection processing at the time of a big bonus game.

FIG. 3 is a conceptual view of a refresh register, FIG. 4 is an explanatory view showing how the light-emitting patterns of the reel lamps 44 are selected, and FIGS. 5 and 6 are explanatory views of the light-emission patterns of the reel lamps 44. Also, FIG. 7 is a flowchart showing the outlined procedure of control processing in the slot machine, and FIG. 8 is a flowchart showing the details of reel lamp demo selection processing at the time of a big bonus game.

In the explanation of each of the above-mentioned drawings (as well as FIGS. 9 to 13), the big bonus games and regular bonus games are abridged as "BB" and "RB," respectively.

The indicating random number generator 45 for generating the random numbers used in the first embodiment is constituted by a refresh register having 8 bits from "0" to "7" as shown in FIG. 3, from which 5 bits from "0" to "4" are used for generating 32 random numbers from "0" to "31."

The number of random numbers generated in the indicating random number generator 45 is not limited to 32, but can appropriately be changed according to the number of stages of set values and the like.

In the slot machine 1, as shown in FIG. 4, the probability of occurrence of big bonus games can be set by the setting switch 46. For example, this set value can be set at six stages within the range of 1/240 to 1/300 (e.g., setting 1=1/297, setting 2=1/282, setting 3=1/277, setting 4=1/264, setting 5=1/256, and setting 6=1/240). In the embodiment shown in FIG. 4, the probability of the occurrence of big bonus games is the lowest in the setting 1, successively increases through the settings 2, 3, 4, and 5, and is the highest in the setting 6.

As shown in the upper part of FIG. 4, the individual set values are operated as 6-stage values of "0" to "5" within the control unit. Also, as mentioned above, the indicating random number generator 45 generates 32 random numbers.

For selecting flash patterns (light-emitting patterns of the reel lamps 44), the sum value obtained by adding the stage value set by the setting switch 46 and the random number value generated by the indicating random number generator 45 together is used. Namely, flash pattern 1 is used when the sum value is less than "18," whereas flash pattern 2 is used when the sum value is "18" or greater.

The minimum and maximum values of the sum value become smaller as the set value used as a reference is smaller, and become greater as the reference set value is greater. In other words, the minimum and maximum values become smaller as the probability of occurrence of big bonus games is lower, and become greater as the probability of occurrence of big bonus games is higher.

Hence, as the probability of occurrence of big bonus games is lower, the frequency of occurrence of flash pattern 1 becomes higher and the frequency of occurrence of flash pattern 2 becomes lower; whereas, as the probability of occurrence of big bonus games is higher, the frequency of occurrence of flash pattern 2 becomes higher and the frequency of occurrence of flash pattern 1 becomes lower.

Selecting ratios of flash pattern 1 and flash pattern 2 are as shown in the lower part of FIG. 4. For example, their ratio is 18:14 in the setting 1 in which the probability of occurrence of big bonus games is the lowest, so that the selecting ratio of flash pattern 2 is 0.7778; whereas their ratio is 13:19 in the setting 6 in which the probability of occurrence of big bonus games is the highest, so that the selecting ratio of flash pattern 2 is 1.4615.

Thus, when the sum value of the set value and random number value is used for selecting flash patterns, the estimation of probability of occurrence of big bonus games can roughly be indicated. Namely, the player can determine that there is a strong possibility of the probability of occurrence of big bonus games being set lower when the flash pattern 1 appears more often than the flash pattern 2, and that there is a strong possibility of the probability of occurrence of big bonus games being set higher when the flash pattern 2 appears more often than the flash pattern 1.

In the above-mentioned flash pattern 1, as shown in FIG. 5, the reel lamps 44 are blinked in six stages, such that all the reel lamps 44 (z1 to z9) are turned off in the first and second stages; five reel lamps 44 (z1, z4, z7, z8, z9) in total consisting of the upper, middle, and lower ones in the left reel 5*a*, the lower one in the center reel 5*b*, and the lower one in the right reel 5*c* are lit so as to represent an L-shape in the third and fourth stages; and all the reel lamps 44 (z1 to z9) are turned off again in the fifth and sixth stages.

Here, the L-shape represented in the third and fourth stages indicates that the probability of occurrence of big bonus games is low. Each stage lasts 103.40 ms, for example.

In the above-mentioned flash pattern 2, as shown in FIG. 6, the reel lamps 44 are blinked in six stages, such that all the reel lamps 44 (z1 to z9) are turned off in the first and second stages; seven reel lamps 44 (z1, z3, z4, z5, z6, z7, z9) in total consisting of the upper, middle, and lower ones in the left reel 5*a*, the middle one in the center reel 5*b*, and the upper, middle, and lower ones in the right reel 5*c* are lit so as to represent an H-shape in the third and fourth stages; and all the reel lamps 44 (z1 to z9) are turned off again in the fifth and sixth stages.

Here, the H-shape represented in the third and fourth stages indicates that the probability of occurrence of big bonus games is high. Each stage lasts 103.40 ms, for example.

Without being restricted to those mentioned above, the flash patterns may have other modes. For example, the reel lamps 44 (z1 to z9) to be lit may have different positions so as to represent other letters, and their lighting timings may be changed as well.

With reference to FIGS. 7 and 8, the control processing in the slot machine 1 will now be explained.

The slot machine 1 can start a game when game medals are inserted into the medal insertion slot 11 or the bet switch 12 or the max bet switch 13 is operated so that game medals are accepted within a credit range. Here, when the start switch 16 is operated, all the reels 5*a* to 5*c* start rotating, whereby a plurality of symbols are displayed within the display windows 4*a* to 4*c* as being moved at a high speed.

Then, as shown in FIG. 7, when the stop switches 17*a* to 17*c* are operated after each reel 5*a* to 5*c* reaches a predetermined rotating speed, reel stop control processing (S1) for stopping rotating the respective reels 5*a* to 5*c* corresponding to the operated stop switches 17*a* to 17*c* is carried out.

Subsequently, reel lamp demo selection processing in a normal game (S2) is carried out, so as to select the light-emitting pattern of the reel lamps 44 in the normal game. Then, setting processing after stopping the reels (S3) is carried out, so as to set the states of the reels 5*a* to 5*c* after stopping the reels. Thereafter, winning query processing (S4) is carried out, so as to determine whether the combination of the symbols stopped on an effective winning line constitutes a winning mode or not.

Further, it is determined whether any winning mode of a big bonus game is attained or not (S5). If a winning mode of a big bonus game is attained, then reel lamp demo selection processing at the time of a big bonus game (S6), which will be explained later in detail, is carried out, and winning check medal payout processing (S7) is performed thereafter, so as to pay out a predetermined number of game medals corresponding to each winning mode.

If no winning mode of a big bonus game is attained, on the other hand, then the reel lamp demo selection processing at the time of a big bonus game (S6) is skipped.

Then, it is determined whether or not a big bonus game or a regular bonus game is being performed or not (S8). If the big bonus game or regular bonus game is being performed, then winning check processing in the respective game (S9) is carried out, so as to pay out a predetermined number of game medals at the time of winning.

Though not depicted, after predetermined post-processing operations and the like are carried out subsequent thereto, the above-mentioned processing operations (S1) to (S9) are repeated, so as to control games in the slot machine 1.

In the above-mentioned reel lamp demo selection processing at the time of a big bonus game (S6), as shown in FIG. 8, the set value set by the setting switch 46 and the random value generated by the indicating random number generator 45 are added together (S61), and then a reel lamp demo table storing the light-emitting patterns of the reel lamps 44 is initialized (S62).

Here, it is determined whether the sum value of the set value and the random number value is at least "18" or not (S63). If the sum value is at least "18," then "1" is added to the initial value of the reel lamp demo table (S64), and the reel lamp demo corresponding to the resulting value of the reel lamp demo table is carried out (S65).

Namely, if the sum value is less than "18," then the initial value of the reel lamp demo table is used, whereby the reel lamps 44 are blinked in the flash pattern 1. If the sum value is at least "18," then the value obtained by adding "1" to the initial value of the reel demo table is used, whereby the reel lamps 44 are blinked in the flash pattern 2.

Second Embodiment of Control Processing

In the following, a second embodiment in which winning sounds of a big bonus game generated from the speaker 21 are changed so as to indicate the probability of occurrence of special games will be explained.

Figure 9:
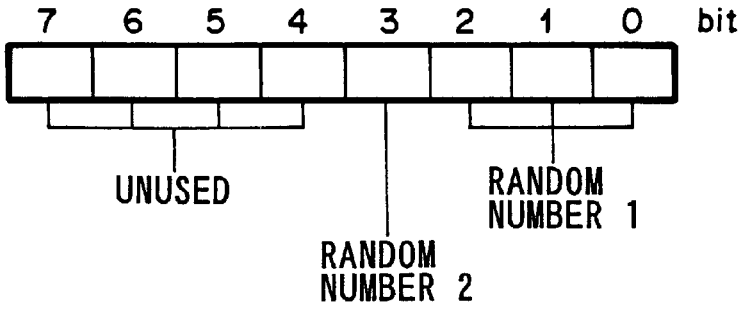
FIG. 9 is a conceptual view of a refresh register in accordance with a second embodiment.
Figure 10:
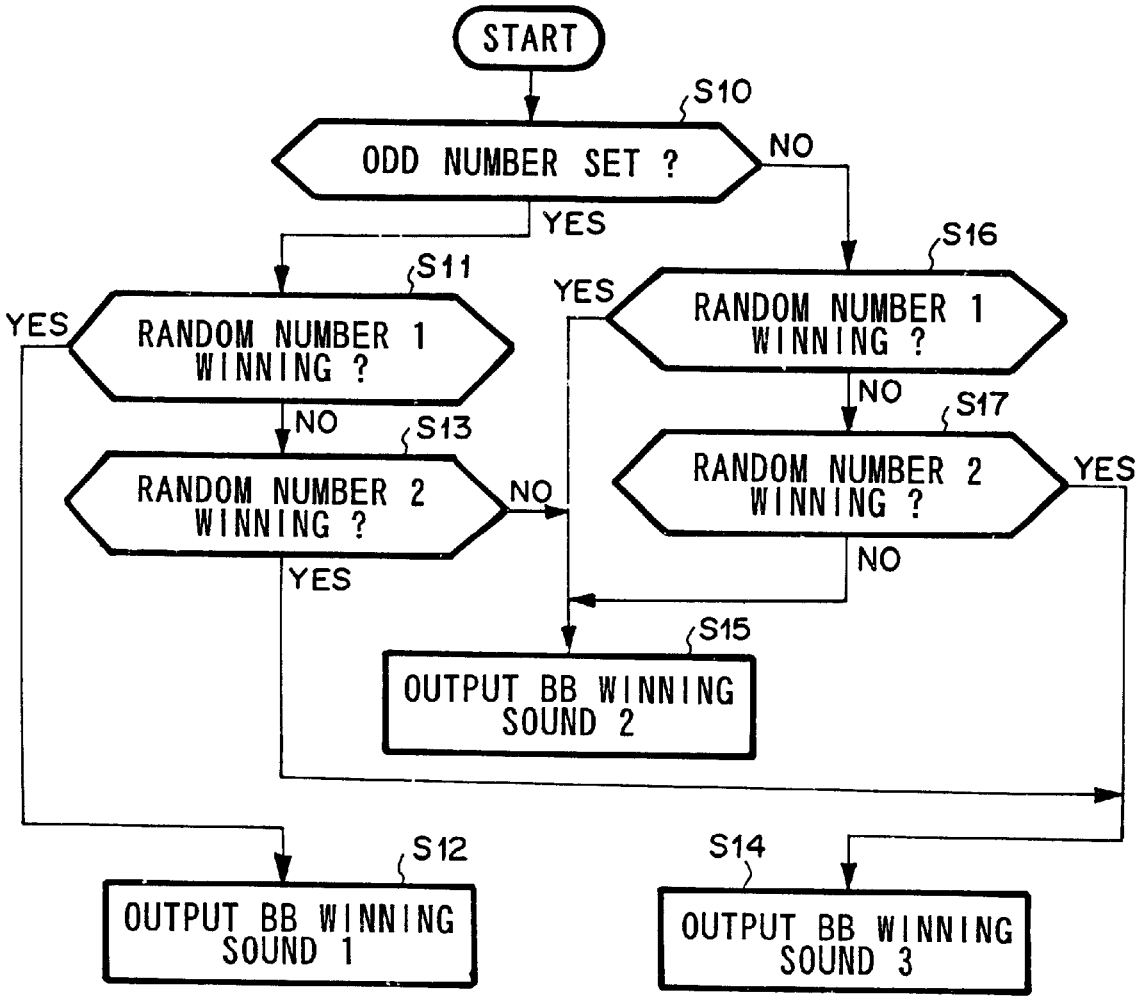
FIG. 10 is a flowchart showing the procedure of a process of selecting winning sounds of the big bonus game.
Figure 12:
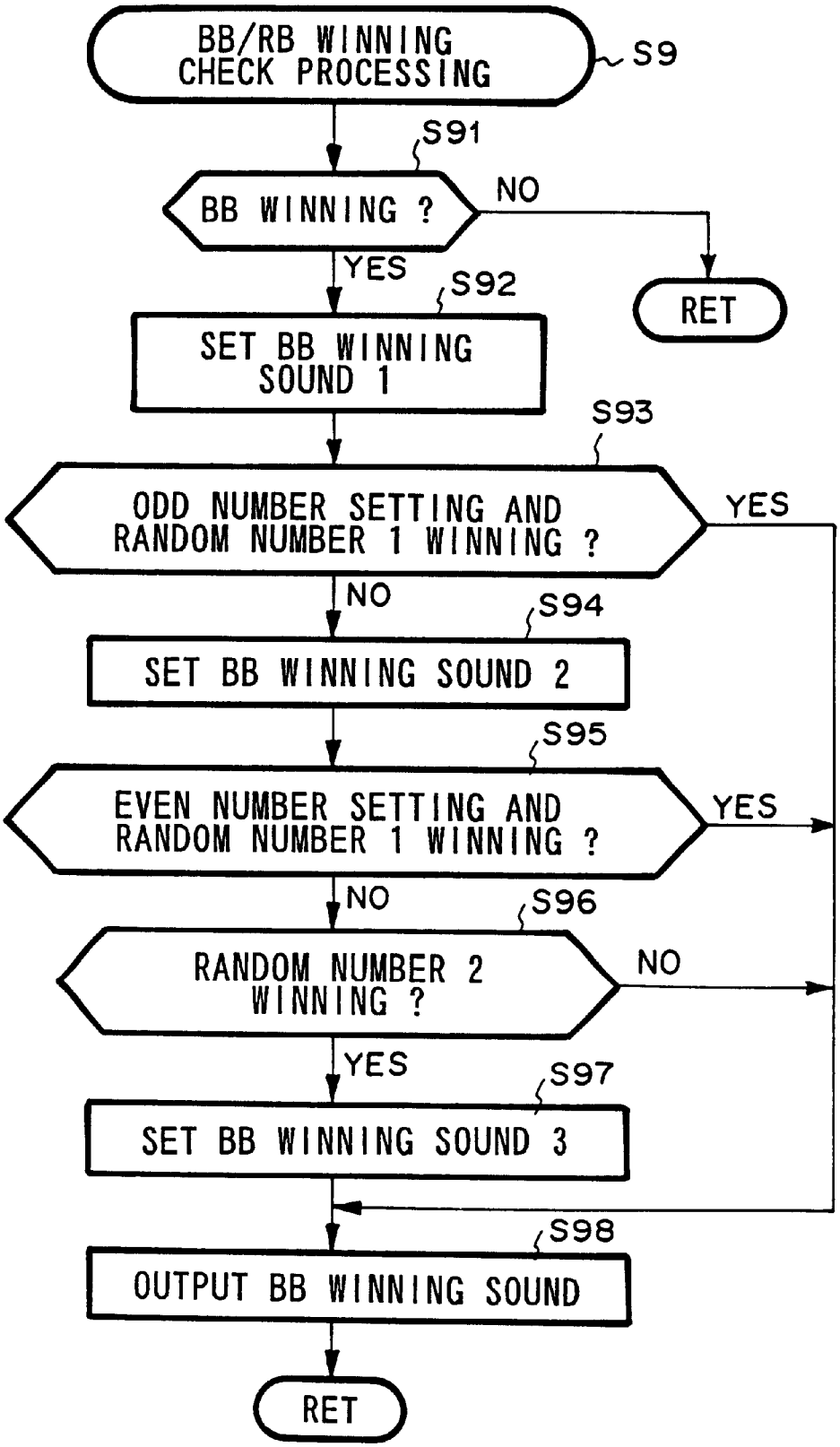
FIG. 12 is a flowchart showing the details of winning check processing for big bonus games and regular bonus games.
Figure 13:
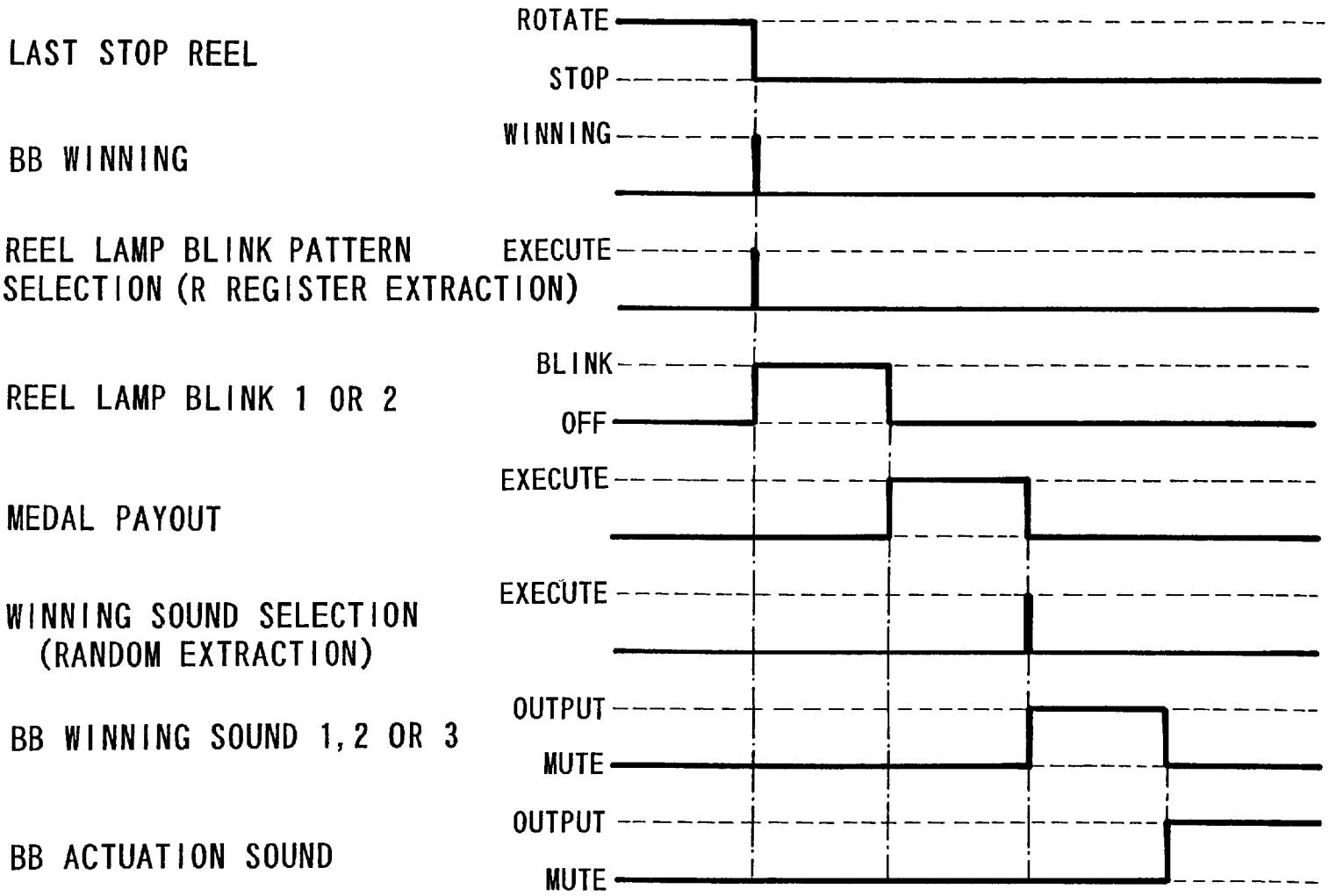
FIG. 13 is a timing chart showing a timing at which sound effects of the big bonus game are generated.

FIG. 9 is a conceptual view of a refresh register, FIG. 10 is a flowchart showing the procedure of a process of selecting winning sounds of the big bonus game, and FIG. 11 is an explanatory view of sound outputting conditions for the sound effects of the big bonus game. Also, FIG. 12 is a flowchart showing the details of winning check processing for big bonus games and regular bonus games, and FIG. 13 is a timing chart showing a timing at which the sound effects of the big bonus game are generated.

The indicating random number generator 45 for generating the random numbers used in the second embodiment is constituted by a refresh register having 8 bits from "0" to "7" as shown in FIG. 9, from which 3 bits from "0" to "2" are used for generating 8 random numbers from "0" to "7" employed as random number 1, whereas 1 bit of "3" is used for generating "0" or "1" employed as random number 2.

Thus generated random numbers 1 and 2 are used for sampling, while each employing one value as a winning value. Namely, the probability of winning is 1/8 in the random number 1, and 1/2 in the random number 2.

Without being restricted to those mentioned above, the random numbers and winning values generated in the indicating random number generator 45 can appropriately be changed according to the number of stages in the set value and the like.

For selecting the winning sounds of big bonus games generated from the speaker 21, the set value set by the setting switch 46 and the random number value generated by the indicating random number generator 45 are used.

Specifically, as shown in FIG. 10, it is initially determined whether the set value set by the setting switch 46 is an odd number or even number (S10). If the set value is an odd number here, then it is determined whether the random number 1 is winning or not (S11). If the random number 1 is winning, then winning sound 1 is generated from the speaker 21 (S12).

If the random number 1 is not winning, then it is further determined whether the random number 2 is winning or not (S13). If the random number 2 is winning here, then winning sound 3 is generated from the speaker 21 (S14). If the random number 2 is not winning, then winning sound 2 is generated from the speaker 21 (S15).

If the set value is an even number in the above-mentioned determination processing of the set value (S10), then it is determined whether the random number 1 is winning or not (916). If the random number 1 is winning, then the winning sound 2 is generated from the speaker 21 (S15). If the random number 1 is not winning, then it is further determined whether the random number 2 is winning or not (S17). If the random number 2 is winning here, then the winning sound 3 is generated from the speaker 21 (S14). If the random number 2 is not winning, then the winning sound 2 is generated from the speaker 21 (S15).

As each of the above-mentioned determination processing operations is carried out, the winning sounds 1 to 3 are selected, whereby three different kinds of winning sounds are generated from the speaker 21.

The above-mentioned selecting operations of winning sounds will be explained in further detail with reference to FIG. 11.

As explained in the first embodiment as well, the probability of occurrence of big bonus games in the slot machine 1 can be set by the setting switch 46, for example, in six stages within the range of 1/240 to 1/300. Also, the probability of the occurrence of big bonus games is the lowest in the setting 1 and successively increases through the settings 2, 3, 4, and 5, and is the highest in the setting 6.

The relationships among the set value, the winning and losing of random numbers 1 and 2, and the winning sounds 1 to 3 are as shown in FIG. 11. In this case, the settings 1, 3, and 5 are odd number set values, whereas the settings 2, 4, and 6 are even number set values.

As shown in FIG. 11, the winning sound 1 is generated only when the set value is an odd number. Consequently, if the winning sound 1 is generated, then it can be seen that one of the settings 1, 3, and 5 is set, which is not the setting 6 with the highest probability of occurrence of big bonus games at least.

If the winning sound 2 is generated, then the probability of the set value being an odd number is 7/16, whereas the probability of the set value being an even number is 2/16+7/16=9/16. Therefore, it can be seen that the probability of the setting 2, 4, or 6 being selected is slightly higher than the probability of the setting 1, 3, or 5 being selected, i.e., there is a possibility that the probability of occurrence of big bonus games is slightly higher than the average value.

If the winning sound 3 is generated, then the probability of the set value being an odd number is 7/16, whereas the probability of the set value being an even number is 7/16. Therefore, it cannot be seen whether one of the settings 1, 3, and 5 or one of the settings 2, 4, and 6 is selected.

Thus, when the set value and random number value are used for selecting the winning sounds of big bonus games, the estimation of probability of occurrence of big bonus games can roughly be indicated.

Of the control processing in the slot machine 1, winning check processing for big bonus games and regular bonus games (S9) will now be explained with reference to FIG. 12.

Since the outline of the main routine of the control processing in the slot machine 1 is similar to the control processing in the first embodiment shown in FIG. 7, it will not be explained here.

Namely, in the control processing in the second embodiment, as in the control processing shown in FIG. 7, operations from the reel stop control processing (S1) to the winning check processing for big bonus games and regular bonus games (S9) are carried out, predetermined post-processing operations and the like are carried out subsequent thereto, and then the above-mentioned processing operations (S1) to (S9) are repeated, so as to control games in the slot machine 1.

In the winning check processing for big bonus games and regular bonus games (S9), as shown in FIG. 12, it is initially determined whether any winning mode of a big bonus game is attained or not (S91). If a winning mode of a big bonus game is attained, then the winning sound 1 for big bonus games is set (S92).

Subsequently, the set value set by the setting switch 46 and whether the random numbers 1 and 2 generated by the indicating random number generator 45 is winning or not are determined, so as to select the winning sounds (S93 to S98).

Namely, determination processing of the set value (odd number) and the winning of random number 1 (S93) is carried out. If the set value set by the setting switch 46 is an odd number and the random number 1 generated by the indicating random number generator 45 is winning, then the winning sound 1 set by the winning sound 1 setting processing (S92) is generated from the speaker 21 (S98), and the process returns to the main routine.

If it is determined that a mode other than that mentioned above is attained in the determination processing of the set value (odd number) and the winning of random number 1 (S93), then the winning sound 2 is set (S94).

Subsequently, determination processing of the set value (even number) and the winning of random number 1 (S95), and determination processing of the winning of random number 2 (S96) are carried out in series. If the set value set by the setting switch 46 is an even number while the random number 1 generated by the indicating random number generator 45 is winning, or if the random number 2 generated by the indicating random number generator 45 is not winning while in a mode other than that mentioned above, then the winning sound 2 set in the winning sound 2 set processing (S94) is generated from the speaker 21 (S98), and the process returns to the main routine.

If it is determined that a mode other than that mentioned above is attained in the determination processing of the set value (even number) and the winning of random number 1 (S95) and the determination processing of the winning of random number 2 (S96), then the winning sound 3 is set (S97), the winning sound 3 is generated from the speaker 21 (S98), and the process returns to the main routine.

If no winning mode of a big bonus game is attained, on the other hand, then the process returns to the main routine without carrying out the above-mentioned processing operations (S91) to (S98).

In the following, a timing at which sound effects for a big bonus game is generated will be explained with reference to FIG. 13.

As shown in FIG. 13, at the timing when the last stopping reel (which is usually the right reel 5*c*) among the three reels 5*a* to 5*c* stops rotating, it is determined whether a big bonus game is won or not. If a winning mode of a big bonus game is attained, then a random number is extracted by the refresh register, and a flash pattern of the reel lamps 44 is selected. Then, the reel lamps 44 are blinked according to thus selected flash pattern 1 or flash pattern 2. After the blinking of the reel lamps 44 is completed, a predetermined number of game medals are paid out.

At the timing when the payout of game medals is completed, a winning sound is selected, and thus selected winning sound 1 to 3 is generated from the speaker 21. Then, at the timing when the winning sound generation is completed, actuation sounds of the big bonus game are generated.

Though three kinds of winning sounds are generated in the above-mentioned second embodiment, two kinds or four or more kinds of winning sounds may be generated as well. Also, the plurality of kinds of winning sounds may be of any kind as long as they are distinguishable from each other. For example, the plurality of kinds of winning sounds may be constituted by a plurality of tunes having different melodies, the same melody with different tempos and intervals, or verbal expressions of estimations of set values.

Also though the estimation of probability of occurrence of big bonus games is indicated not only by generating a winning sound from the speaker but also by a light-emitting pattern of the reel lamps 44, the latter may be omitted.

Other Embodiments

Though the above-mentioned individual embodiments are explained, by way of example, in regard to the slot machine 1 as a typical gaming machine, the present invention is also applicable to other gaming machines such as pachinko machine, pachislo gaming machine, and the like, for example.

Also, though the indicating means is configured so as to indicate an estimation of the set value, it may be configured so as to indicate a detail of the set probability of occurrence of special games. Namely, depending on the business strategy and the like in a game parlor, there are cases where the profit of players and the profit of the game parlor can be balanced even when the detail of the set probability of occurrence of special games is indicated. In such a case, the detail of the set probability of occurrence of special games can be indicated by changing the light-emitting patterns of the reel lamps 44 or the sound effect patterns generated from the speaker 21, which is an embodiment of the above-mentioned indicating means.

Also, though the reel lamps 44 are employed as the light-emitting means, other devices may constitute the light-emitting means. For example, the light-emitting means may be constituted by a decorative lamp disposed in the front face of the gaming machine; or a lamp, LED, seven-segment LED, dot-matrix display, or the like separately provided for indicating the probability of occurrence of special games.

Also, in a slot machine of a type equipped with a display device such as a liquid crystal display for showing simulated reels, attractions in bonus games, game histories, and the like, character images corresponding to their respective occurrence probability indications can be used as the indicating means.

When the reel portion is taken into consideration, the indication can be made by rotational functions of reels, such as rotating speed, wobbling, reverse rotation, and the like, which are different from their normal rotations.

Also, though the speaker 21 is employed as the sound effect generating means, other devices may constitute the sound effect generating means. For example, a hammer or the like adapted to generate hitting sounds can constitute the sound effect generating means. In this case, the detail or estimation of the probability of occurrence of special games may be indicated by the number of generated hitting sounds or the like.

Though the probability of occurrence of special games is indicated by the indicating means at the timing when a special game is won, the indicating timing is not restricted thereto. For example, the indicating timing may be positioned at the completion of the special game, at predetermined intervals, at the completion of a predetermined number of games, or the like.

Due to the above-mentioned configurations, the gaming machine of the present invention can yield effects such as those mentioned in the following.

In the gaming machine in accordance with the first aspect of the present invention, the player is informed of the set value set by the setting means.

As a consequence, the player can perceive the probability of occurrence of special games, so as to enhance the expectation of special games, thereby being able to fully enjoy the pleasure of gaming.

In the gaming machine in accordance with the second aspect of the present invention, light-emitting patterns in the light-emitting means are changed according to the set value set by the setting means, so as to inform the player of the set value set by the setting means.

As a consequence, the player can perceive the probability of occurrence of special games by seeing the light-emitting pattern of the light-emitting means, so as to enhance the expectation of special games, thereby being able to fully enjoy the pleasure of gaming.

In the gaming machine in accordance with the third aspect of the present invention, sound effect patterns generated from the sound effect generating means are changed according to the set value set by the setting means, so as to inform the player of the set value set by the setting means.

As a consequence, the player can perceive the probability of occurrence of special games by hearing the sound effect pattern generated from the sound effect generating means, so as to enhance the expectation of special games, thereby being able to fully enjoy the pleasure of gaming.

In the gaming machine in accordance with the fourth aspect of the present invention, the light-emitting patterns in the light-emitting means and the sound effect patterns generated from the sound effect generating means are changed according to the set value set by the setting means, so as to inform the player of the set value set by the setting means.

As a consequence, the probability of occurrence of special games is indicated visually and audibly, whereby the player can reliably perceive the probability of occurrence of special games, thus being able to further enjoy the pleasure of gaming.

In the gaming machine in accordance with the fifth aspect of the present invention, the set value set by the setting means is processed by use of a random number generated by the random number generating means, so as to inform the player of an estimation of the set value set by the setting means.

As a consequence, the player can perceive, though roughly, the estimation of the probability of occurrence of special games, and thus can use it as a criterion for choosing gaming machines, and can enhance the expectation of special games, thereby being able to fully enjoy the pleasure of gaming. Also, since the probability of occurrence of special games is not indicated in detail, the profit of players and the profit of game parlors can be balanced, so as to allow games to be played soundly.

In the gaming machine in accordance with the sixth aspect of the present invention, the set value set by the setting means is processed by use of a random number generated by the random number generating means, thus processed value is ranked according to a predetermined condition, and then the player is informed of the ranked value.

As a consequence, the player can perceive the estimation of the probability of occurrence of special games by determining which rank the reported set value belongs to.

In the gaming machine in accordance with the seventh aspect of the present invention, the light-emitting patterns in the light-emitting means are changed, so as to inform the player of the estimation of the set value set by the setting means.

As a consequence, the player can visually perceive the estimation of the probability of occurrence of special games from the light-emitting pattern of the light-emitting means.

In the gaming machine in accordance with the eighth aspect of the present invention, the sound effect patterns generated from the sound effect generating means are changed, so as to inform the player of the estimation of the set value set by the setting means.

As a consequence, the player can audibly perceive the estimation of the probability of occurrence of special games from the sound effect pattern generated from the sound effect generating means.

In the gaming machine in accordance with the ninth aspect of the present invention, the light-emitting patterns in the light-emitting means and the sound effect patterns generated from the sound effect generating means are changed according to the set value set by the setting means, so as to inform the player of the estimation of the set value set by the setting means.

As a consequence, from the light-emitting pattern in the light-emitting means and the sound effect pattern generated from the sound effect generating means, the player can visually and audibly perceive the estimation of the set value set by the setting means, whereby the indication of the estimation of the setting value would become further reliable.

In the gaming machine in accordance with the tenth aspect of the present invention, the estimation of the set value set by the setting means is indicated upon winning of a special game.

As a consequence, since the estimation of the set value is indicated at the time of occurrence of the special game, which is a special event, on which the player's attention is focused, the estimation of the set value can be indicated more reliably. Also, the expectation of the next occurrence of special games can be enhanced, whereby games can further be enjoyed.

What is claimed is:

1. A gaming machine which causes a game to be played on condition that a game medium is inserted therein, and allows a player to play a special game more advantageous than a normal game when a predetermined condition is achieved according to a preset probability of occurrence, said gaming machine comprising:

a switch for setting a set value of the preset probability of occurrence of said special game at a plurality of setting stages; and an indicator for informing said player of the set value set by said switch for setting.

2. A gaming machine according to claim 1, wherein said indicator comprises light-emitting source adapted to emit light in a plurality of light-emitting patterns, said light-emitting patterns in said light-emitting source being changed according to the set value set by said switch for setting, so as to inform said player of the set value set by said switch for setting.

3. A gaming machine according to claim 2, wherein said light-emitting source comprises a decorative lamp disposed in the front face of said gaming machine.

4. A gaming machine according to claim 2, wherein said light-emitting source comprises a lamp separately provided for indicating the probability of occurrence of special games.

5. A gaming machine according to claim 1, wherein said indicator comprises sound effect generator adapted to generate a plurality of sound effect patterns, said sound effect patterns generated from said sound effect generator being changed according to the set value set by said switch for setting so as to inform said player of the set value set by said switch for setting.

6. A gaming machine according to claim 5, wherein said sound effect generator comprises a hammer to generate hitting sounds.

7. A gaming machine according to claim 1, wherein said indicator comprises light-emitting source adapted to emit light in a plurality of light-emitting patterns, and sound effect generator adapted to generate a plurality of sound effect patterns, said light-emitting patterns in said light-emitting source and said sound effect patterns generated from said sound effect generator being changed according to the set value set by said switch for setting, so as to inform said player of the set value set by said switch for setting.

8. A gaming machine according to claim 7, wherein said light-emitting source comprises a decorative lamp disposed in the front face of said gaming machine.

9. A gaming machine according to claim 7, wherein said light-emitting source comprises a lamp separately provided for indicating the probability of occurrence of special games.

10. A gaming machine according to claim 7, wherein said sound effect generator comprises a hammer to generate hitting sounds.

11. A gaming machine according to claim 1, wherein said indicator performs an indication upon winning of said special game.

12. A gaming machine according to claim 1, wherein said indicator comprises a display for showing simulated reels, attractions in bonus games and game histories, wherein said display shows character images corresponding to said probability of occurrence.

13. A gaming machine according to claim 1, wherein said gaming machine comprises a slot machine, and said probability of occurrence is indicated by rotational functions of reels, which are different from their normal rotations.

14. A gaming machine according to claim 1, wherein an estimation of the set value set by said switch is calculated by addition of a setting stage value number to the random number generated by the random number generator.

15. A gaming machine which causes a game to be played on condition that a game medium is inserted therein, and allows a player to play a special game more advantageous than a normal game when a predetermined condition is achieved according to a preset probability of occurrence, said gaming machine comprising:

a switch for setting a set value of the preset probability of occurrence of said special game at a plurality of setting stages;

random number generator for generating a random number within a predetermined numerical range;

an apparatus for determining, according to a setting stage value number set by said switch for setting and a random number value generated by said random number generator, an estimation of the set value set by said switch for setting; and an indicator for informing, according to the determination made by said apparatus for determining, said player of the estimation of the set value set by said switch for setting.

16. A gaming machine according to claim 15, wherein said indicator performs an indication upon winning of said special game.

17. A gaming machine according to claim 15, wherein said indicator comprises a display for showing simulated reels, attractions in bonus games and game histories, wherein said display shows character images corresponding to said probability of occurrence.

18. A gaming machine according to claim 15, wherein said gaming machine comprises a slot machine, and said probability of occurrence is indicated by rotational functions of reels, which are different from their normal rotations.

19. A gaming machine according to claim 15, wherein said estimation of the set value set by said switch is calculated by addition of the setting stage value number to the random number generated by the random number generator.

20. A gaming machine which causes a game to be played on condition that a game medium is inserted therein, and allows a player to play a special game more advantageous than a normal game when a predetermined condition is achieved according to a preset probability of occurrence, said gaming machine comprising:

an apparatus for setting a set value of the preset probability of occurrence of said special game at a plurality of setting stages;

random number generator for generating a random number within a predetermined numerical range;

an apparatus for determining, according to a setting stage value number set by said apparatus for setting and a random number value generated by said random number generator, an estimation of the set value set by said apparatus for setting;

an indicator for informing, according to the determination made by said apparatus for determining, said player of an estimation of the set value set by said apparatus for setting;

wherein said apparatus for determining determines the estimation of the set value by adding the setting stage value number set by said apparatus for setting and the random number value generated by said random number generator together and ranking the resulting value under a predetermined condition, and wherein said indicator performs an indication corresponding to the ranking effected by said apparatus for determining.

21. A gaming machine according to claim 20, wherein said indicator comprises light-emitting source adapted to emit light in a plurality of light-emitting patterns, said light-emitting patterns in said light-emitting source being changed, so as to inform said player of the estimation of the set value set by said apparatus for setting.

22. A gaming machine according to claim 21, wherein said light-emitting source comprises a decorative lamp disposed in the front face of said gaming machine.

23. A gaming machine according to claim 21, wherein said light-emitting source comprises a lamp separately provided for indicating the probability of occurrence of special games.

24. A gaming machine according to claim 20, wherein said indicator comprises sound effect generator adapted to generate a plurality of sound effect patterns, said sound effect patterns generated from said sound effect generator being changed, so as to inform said player of the estimation of the set value set by said apparatus for setting.

25. A gaming machine according to claim 24, wherein said sound effect generator comprises a hammer to generate hitting sounds.

26. A gaming machine according to claim 20, wherein said indicator comprises light-emitting source adapted to emit light in a plurality of light-emitting patterns, and sound effect generator adapted to generate a plurality of sound effect patterns, said light-emitting patterns in said light-emitting source and said sound effect patterns generated from said sound effect generator being changed, so as to inform said player of the estimation of the set value set by said apparatus for setting.

27. A gaming machine according to claim 26, wherein said light-emitting source comprises a decorative lamp disposed in the front face of said gaming machine.

28. A gaming machine according to claim 26, wherein said light-emitting source comprises a lamp separately provided for indicating the probability of occurrence of special games.

29. A gaming machine according to claim 26, wherein said sound effect generator comprises a hammer to generate hitting sounds.

* * * * *